United States Patent [19]

Miller et al.

[11] Patent Number: 4,984,621

[45] Date of Patent: Jan. 15, 1991

[54] ELEMENT BASKET ASSEMBLY FOR HEAT EXCHANGER

[75] Inventors: Norman P. Miller; Leo W. Eaton, both of Wellsville, N.Y.

[73] Assignee: ABB Air Preheater, Inc., Wellsville, N.Y.

[21] Appl. No.: 553,032

[22] Filed: Jul. 16, 1990

[51] Int. Cl.[5] ..... F28D 19/04

[52] U.S. Cl. ..... 165/10; 165/8

[58] Field of Search ..... 165/8, 10

[56] References Cited

U.S. PATENT DOCUMENTS

| | | | |
|---|---|---|---|
| 3,314,472 | 4/1967 | Krumm et al. | 165/10 |
| 3,379,240 | 4/1968 | Woolard et al. | 165/10 |
| 4,557,318 | 12/1985 | Bellows | 165/10 |
| 4,561,492 | 12/1985 | Bellows | 165/10 |
| 4,789,024 | 12/1988 | Muscato | 165/10 |
| 4,838,342 | 6/1989 | Goetschius | 165/10 |

*Primary Examiner*—Albert W. Davis, Jr.

*Attorney, Agent, or Firm*—John H. Mulholland; William W. Habelt

[57] ABSTRACT

An element basket assembly (30) for a rotary regenerative heat exchanger (2) is comprised of a plurality of heat transfer element plates (32) stacked in an array within a supporting basket frame formed of upper and lower plank-like shell members (34,44) each formed into a trough-like member having a base end (342,442) and a pair of spaced outwardly extending legs (344,444). The shell members (34,44) are interconnected at their base ends by corner angle bars (35) and at the outward ends of their legs by closure member (36) to form a four-sided frame housing. Retaining grates (**42*a*,42*b*) are mounted within the trough-like shell members (34,44) so as to extend across the upper and lower end surfaces of the stacked element plates (32**) for retaining the element plates within the housing.

4 Claims, 3 Drawing Sheets

ELEMENT BASKET ASSEMBLY FOR HEAT EXCHANGER

BACKGROUND OF THE INVENTION

The present invention relates to heat transfer element baskets and, more specifically, to an assembly of heat absorbent plates in a basket for use in a heat exchanger wherein heat is transferred by means of the plates from a hot heat exchange fluid to a cold heat exchange fluid. The present invention has particular application in heat transfer apparatus of the rotary regenerative type wherein the heat transfer element plates carried in such baskets are heated by contact with a hot gaseous heat exchange fluid and thereafter brought in contact with a cool gaseous heat exchange fluid to which the heat transfer element gives up its heat. The element basket of the present invention is most advantageously suited for use in the hot end of a rotary regenerative heat exchanger.

One type of heat exchange apparatus commonly used for gas-to-gas heat exchange in the process industry and for gas-to-air heat exchange on utility steam generators is the well-known rotary regenerative heat exchanger. Typically, a rotary regenerative heat exchanger has a cylindrical rotor divided into sector-shaped compartments in which are disposed a mass of heat transfer element which, as the rotor turns, is alternately exposed to a stream of heating gas and then upon rotation of the rotor to a stream of cooler air or other gaseous fluid to be heated. The heat absorbent mass typically comprises a plurality of heat transfer element basket assemblies mounted in sector shaped compartments. Each of the heat transfer element basket assemblies houses a plurality of heat transfer plates which when exposed to the heating gas absorb heat therefrom and then when exposed to the cool air or other gaseous fluid to be heated, the heat absorbed from the heating gas by the heat transfer plates is transferred to the cooler gas.

Most commonly, such an element basket comprises a frame-like housing having a plurality of sheet-like heat transfer plates disposed therein. Typically, the element basket housing comprises a frame formed of a pair of spaced plate-like end members held together by paired side straps interconnecting the end members along the sides thereof such as shown in U.S. Pat. Nos. 3,314,472; 4,561,492 and 4,606,400. A plurality of heat transfer plates are stacked in closely spaced relationship within the basket housing to provide a plurality of passageways between adjacent plates through which the heat exchange fluids pass. The side straps which interconnect the spaced end members typically extend in pairs along the opposite sides of the stacked array of heat exchange elements. On each side of the heat exchange element is a first side strap extending between the upper regions of the spaced end members and a second side strap extending between the lower region of the end members in spaced, parallel relationship to the first side strap. The side straps may be flanged inwardly along the longitudinal edge lying at the edge of the basket assembly to provide a retaining surface for preventing the heat transfer plates from falling out of the open ends of the element basket as shown in U.S. Pat. No. 3,314,472.

Element baskets have also been constructed in the past with a box-like housing as shown in U.S. Pat. No. 3,379,240. As depicted therein, the element basket is formed of a solid sheet folded into a generally U-shaped member having a base end and two outwardly extending, diverging legs. A solid accurate end plate is welded between the outward end portions of the legs of the U-shaped member after the heat exchange element sheets have been stacked within the housing defined by the U-shaped member. A resilient curved pressure member is disposed between the stacked element sheets and the base end of the U-shaped member to ensure that a compressive force is imposed against the stacked element to keep the element sheets in a tightly packed array against the end plate welded between the legs of the U-shaped member.

Whether the element basket is in the form of a frame-like housing or a box like housing, a plurality of retaining bars are typically welded between the end members across the top and bottom ends thereof to further assist in keeping the heat transfer element plates from falling out of the open ends of the element basket. The retaining bars may merely be disposed to lie across the top and bottom edges of the heat transfer element plates as shown in U.S. Pat. No. 4,561,492. Alternatively, in order to provide a shorter basket for a given plate height, the retaining bars may be disposed within recesses cut in the top and bottom edges of the heat transfer element plates as shown in U.S. Pat. No. 4,606,400.

The retaining bars also serve as structural members for supporting lifting means to facilitate handling of the assembled element baskets and, in particular, to facilitate the installation and removal of the element baskets from the heat exchanger. Typically, the lifting means comprises a pair of spaced apart holes formed in a centrally located retaining bar as shown in U.S. Pat. No. 4,552,204, or a pair of spaced apart pins integral with and passing through a centrally located retaining bar as shown as in U.S. Pat. No. 4,557,318. When the lifting means comprises a pair of holes in the aforementioned U.S. Pat. No. 4,552,204, the element basket is lifted by means of a pair of clevis means which are disposed to span the central retaining bar about each lifting hole. Each clevis is engaged to the retaining bar by a pin which is passed through the lifting hole and each side of the clevis spanning the bar. When the lifting means comprises a pair of lifting pins as in the aforementioned U.S. Pat. No. 4,557,318, the element basket is lifted by means of a pair of lifting lugs which simply grasp the pins extending through the central retaining bar.

Such prior art element baskets have performed well over the years. However, such box-like element baskets are limited in use because of their weight to the cold end of the heat exchanger as baskets in the cold end are generally only about a foot deep. Due to the solid wall structure of such box-like element baskets, the weight and the material costs of deeper box-like baskets would be excessive. Prior art frame-like baskets, while being lighter than similarly sized box-like baskets, are more labor intensive to produce due to the number of separate members which must be welded together to form the frame-like housing. Additionally, distortion of the bar-like members may occur during the welding together of the frame which can lead to difficulty in maintaining proper tolerances.

It is an object of the present invention to provide an improved element basket assembly wherein the element basket is of a frame-like construction but which is less suspectable to distortion and less labor intensive to assemble than prior art frame-like baskets, while also being lighter than prior art box-like baskets of similar size.

SUMMARY OF THE INVENTION

To the fulfillment of this and other objects which will be evident from the description presented herein, the element basket assembly of the present invention comprises a plurality of heat transfer element plates juxtaposed in a stacked array so as to form a plurality of flow passages therethrough, and a basket frame surrounding the stacked array of heat transfer element plates to support the element plates. The basket frame comprises upper and lower shell members each of which are formed into a trough-like member having a base end portion and a pair of spaced legs extending outwardly from the base end portion thereof in a diverging manner, and are interconnected at their base end portion by means such as a pair of spaced angle bars extending vertically between the corners of the base end portions of the vertically spaced upper and lower shell members, and are interconnected at the outward ends of their legs by an end closure plate to form a frame about the stacked array of heat transfer element plates. Retaining means connected to the frame are provided along the upper and lower surfaces of the stacked array of heat transfer element plates for holding the heat transfer element plates within the basket frame.

DESCRIPTION OF A PREFERRED EMBODIMENT

Figure 1:
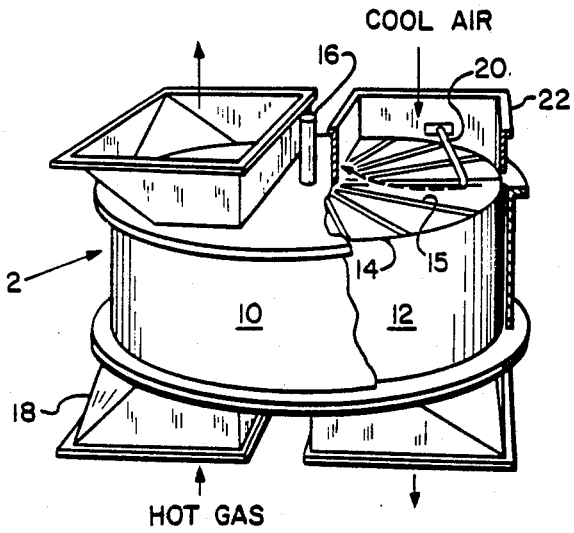
FIG. 1 is a perspective view of a rotary regenerative heat exchanger.
Figure 2:
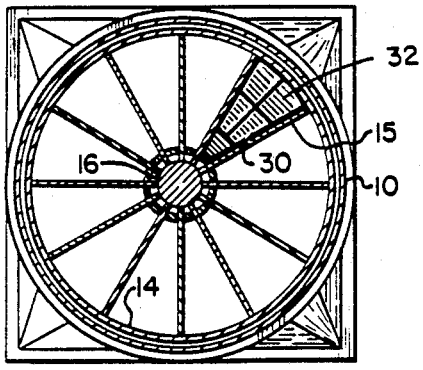
FIG. 2 is a plan view of the rotary regenerative heat exchanger of FIG. 1 taken along line 2—2.

Referring now to the drawings and, more particularly to FIG. 1, there is depicted therein a regenerative heat exchanger apparatus 2 in which the heat transfer element basket assemblies of the present invention may be utilized. The rotary regenerative heat exchanger 2 comprises a housing 10 enclosing a rotor 12 wherein the heat transfer element basket assemblies 30 of the present invention are carried. The rotor 12 comprises a cylindrical shell 14 connected by radially extending diaphragms 15 to the rotor post 16. A heating fluid enters the housing 10 through duct 18 while the fluid to be heated enters the housing 10 from the opposite end thereof through duct 22.

The rotor 12 is turned about its axis by a motor connected to the rotor post 16 through suitable reduction gearing, not illustrated here. As the rotor 12 rotates, the heat transfer element 32, termed sheets or plates, carried within the element basket assemblies 30, disposed within the rotor in the sector-shaped compartments formed by the radially extending diaphragms 15, are first moved in contact with the heating fluid entering the housing through duct 18 to absorb heat therefrom and then into contact with the fluid to be heated entering the housing through duct 22. As the heating fluid passes over the heat transfer element plates, the heat transfer element plates absorb heat therefrom. As the fluid to be heated subsequently passes over the heat transfer element plates, the fluid absorbs from the heat transfer element plates the heat which the plates had picked up when in contact with the heating fluid.

Rotary regenerative heat exchangers are often utilized as air preheaters wherein the heat absorbent element serves to transfer heat from the hot flue gases generated in a fossil fuel-fired furnace to ambient air being supplied to the furnace as combustion air as a means of preheating the combustion air and raising overall combustion efficiency. Very often, the flue gas leaving the furnace is laden with particulate generated during the combustion process. This particulate has a tendency to deposit on heat transfer element plates particularly at the cold end of the heat exchanger where condensation of any moisture in the flue gas may occur. In order to provide for periodic cleaning of the heat transfer element disposed within the element basket assemblies, the heat exchanger is provided with a cleaning nozzle 20 disposed in the passage for the fluid to be heated adjacent the cold end of the rotor 12 and opposite the open end of the heat transfer element basket assemblies. The cleaning nozzle 20 directs a high pressure cleaning fluid, typically steam, water, or air, through the plates as they rotate slowly while the nozzle itself sweeps across the end face of the rotor. The high pressure fluid passing over the heat transfer element plates cause the plates to vibrate so as to jar loose flyash and other particulate deposits clinging thereto. The loosened particulate is then entrained in the high pressure stream and carried out of the rotor.

The heat exchange material carried in the rotor 12 comprises a mass of metallic heat transfer element plates, also termed sheets, commonly formed with corrugations or undulations such that when the plates are placed in abutting relationship in a stacked array, a series of internal passages are provided through which the heating fluid and cooling fluid flow. The plates are typically assembled in an quadrilateral-shaped array of plates with the individual plates held in their stacked order so that they may be handled as an integral assembly for placement within the sector-sector-shaped compartments within the rotor of the heat exchanger.

Figure 3:
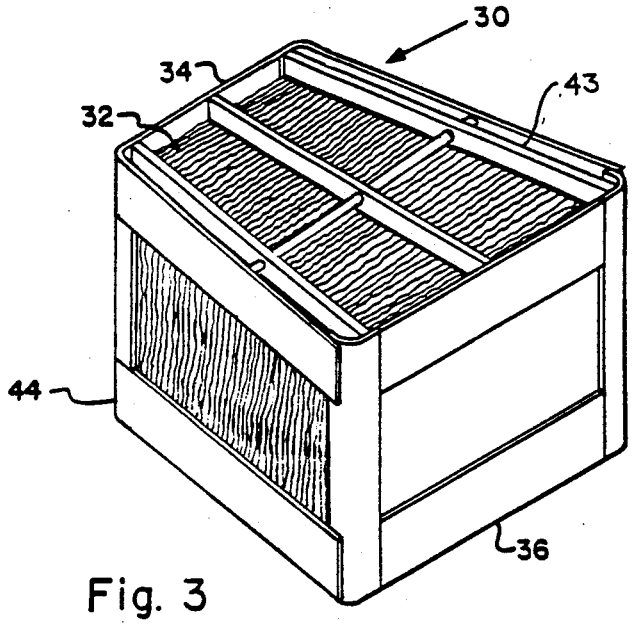
FIG. 3 is a perspective view of an element basket assembly designed in accordance with the present invention.

As illustrated in FIG. 3, the element basket assembly 30 comprises a plurality of heat transfer element plates 32 juxtaposed in spaced relationship to provide a stacked array of plates having a plurality of flow passages therebetween so as to provide a flow path through which heat exchange fluid may pass in heat exchange relationship with the plates 32. The plates 32 are usually thin metal sheets capable of being rolled or stamped to a desired configuration, however, the invention is not limited necessarily to the use of metallic sheets. The plates 32 may be of various surface configuration such as, but not limited to, a flat surface or a corrugated or undulated surface, or a combination thereof with the flat plates stacked alternately between corrugated or undulated plates.

In the element basket assembly 30 of the present invention, the stacked array of heat transfer element plates 32, irrespective of plate configuration or material of construction, are housed in a basket frame formed of an upper trough-like shell member 34 and a lower trough-like shell member 44 interconnected at the corners of their base end portions by vertically extending angle bars 35 and interconnected at the ends of their outwardly extending legs by a closure plate 38 to form a four-sided housing which is closed at its top and bottom by grate-like members 43 and 45 which serve as means for retaining the element plates within the four-sided housing.

Figure 4:
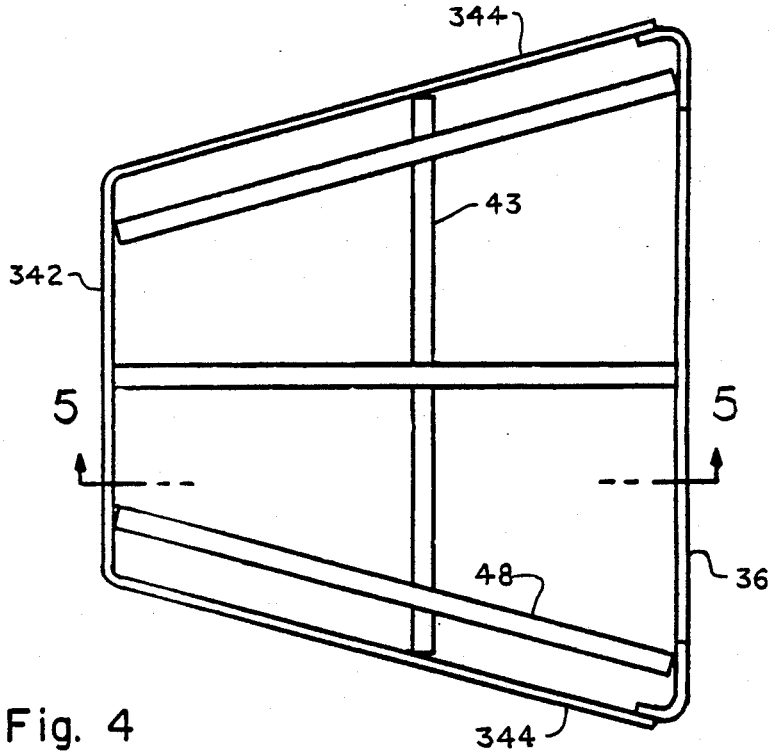
FIG. 4 is a plan view looking down on the element basket assembly of FIG. 3.
Figure 5:
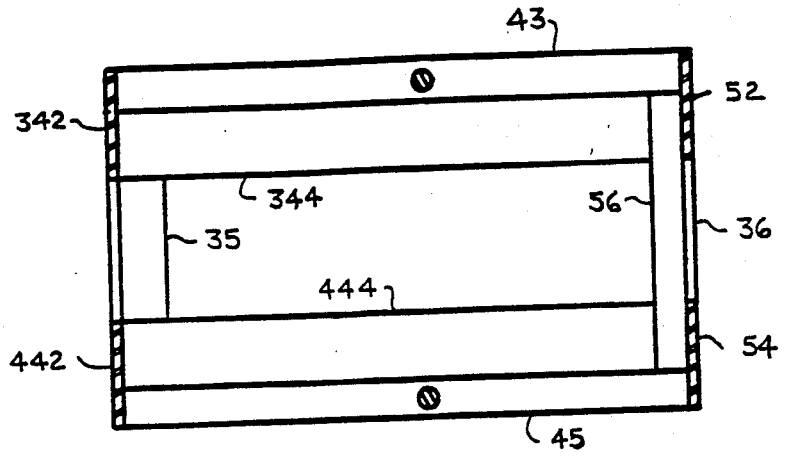
FIG. 5 is a sectional side elevational view of the element basket assembly of FIG. 4 taken along line 5—5.
Figure 6:
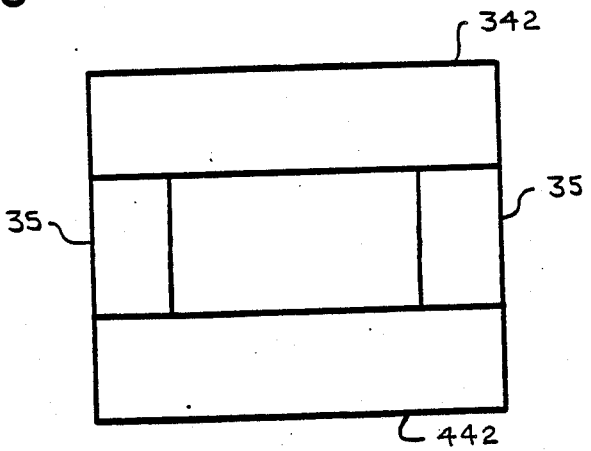
FIG. 6 is an elevational view of the left end of the element basket assembly of FIG. 4.

Referring now to FIGS. 4, 5, 6 and 7, wherein the frame-like structure of the element basket assembly 30 of the present invention is illustrated in various views with the element plates 32 not shown in order to improve the view of the frame-like structure per se, the upper and lower shell members 34 and 44, respectively, each comprise elongated plank-like members formed into a trough-like member having a base end portion 342,442, respectively, and a pair of spaced legs 344,444, respectively, extending outwardly from the base end portion thereof in a diverging manner. As best seen in FIGS. 4, 5 and 6, the upper and lower shell members 34 and 44 are interconnected at their base end portions by brace means 35 which most advantageously comprises a pair of vertically extending angle bars which are disposed one at one corner and one at the other corner of the base end portions 342 and 442 of the upper and lower shell members 34 and 44, respectively, to interconnect the spaced shell members.

Figure 7:
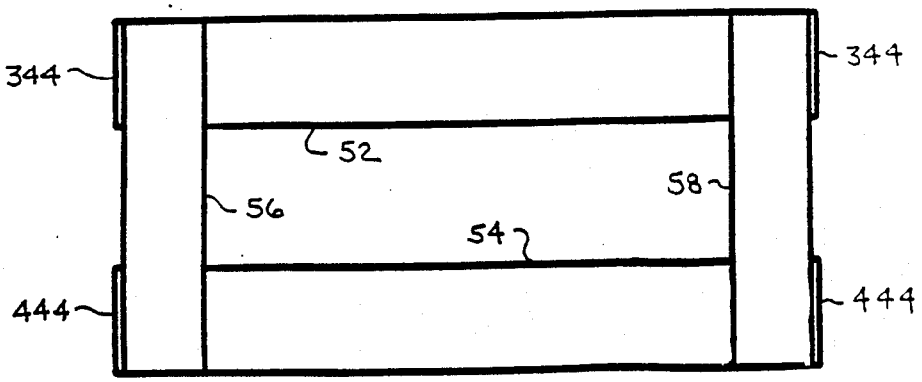
FIG. 7 is an elevational view of the right end of the element basket assembly of FIG. 4.

To close the four-sided basket housing, end closure member 36 is interconnected at its lower end between the end portions of the outwardly extending legs 444 of the lower shell member 44 and at its upper end between the end portions of the outwardly extending legs 344 of the upper shell member 34. Although the end closure member 36 may comprise a solid plate member, it is desirable to form the end closure member 36 as frame-like member in order to reduce the overall weight of the element basket. Accordingly, the end closure member 36 is most advantageously formed of spaced upper and lower, horizontally disposed, plank-like members 52 and 54 interconnected by vertically extending corner angle bars 56 and 58 welded thereto to form a frame-like member having an open center portion as best seen in FIG. 7.

In order to retain the stacked array of heat transfer element 32 within the four-sided housing formed by the interconnected upper and lower shell members 34 and 44 and the end closure member 36, grate-like member 43 is mounted between the upper shell member and the end closure member 36 so as to extend across the upper surface of the stacked array of heat transfer element plates 32 and grate-like member 45 is mounted between the lower shell member 44 and the end closure member 36 so as to extend across the lower surface of the stacked array of heat transfer element plates 32. The grate-like member 45 in effect forms a floor support structure on which the stacked array of heat transfer element 32 rests within the basket housing, while the grate-like member 43 in effect forms a ceiling structure over the basket housing to prevent the element from falling out of the basket housing during shipment and handling. The grate-like members 43 and 45 are formed of only a few bar-like members 48 in order to maintain a large open flow area for the flow of heating gas and gas to be heated into the basket, through the flow passages between adjacent element plates 32, and thence out of the basket, and minimize flow disturbance. As noted previously, lifting means, such as disclosed in commonly assigned U.S. Pat. Nos. 4,552,204 and 4,557,318, may be provided in the retaining bars 48 forming the upper grate-like member 43 in order to facilitate the handling, installation and removal of the element basket assemblies from the heat exchanger.

The assembly of the element basket assemblies 30 of the present invention is less labor intensive than the assembly of convention frame-like baskets. To manufacture the element basket assembly 30 of the present invention, the preformed trough-like upper and lower shells members 34 and 44 are interconnected in spaced relationship by welding angle bars 35 therebetween so as to extend vertically between the corners of the base end portions 342 and 442 the spaced upper and lower shell members 34 and 44 to form a three-sided housing subassembly. As best seen in FIG. 6, only four welds are necessary to form this housing subassembly. The height or depth of the element basket may be readily varied from application to application without greatly increasing the weight of the basket by simply selecting angle bars 35 of the length necessary to give the overall desired basket depth. Next the upper and lower retaining members 43 and 45 are tack welded between the based end portions and the outwardly extending legs of the upper and lower shell members 34 and 44, respectively, to form a housing now ready to receive heat transfer element.

The partially assembled basket frame is now upended with the base end portions of the upper and lower shell members 34 and 44 as its base, and the heat transfer element plates 32 are stacked in side-by-side relationship to fill the basket with the desired number of heat transfer element plates. With the heat transfer element plates 32 so arranged in a stacked array within the partially assembled basket frame, the end closure member 36, which is typically preformed of two horizontally extending members and two vertically extending members as hereinbefore described, is welded between the outward ends of the legs 344 and 444 of the upper and lower shell members 34 and 44 by means of four welds as best seen in FIG. 7.

While the heat transfer element basket assembly has been shown embodied in a rotary regenerative heat exchanger of the type wherein the mass of heat absorbent material is rotated alternately between the heating fluid and the fluid to be heated, it would be appreciated by those skilled in the art that the heat transfer element assembly of the present invention can be utilized in a number of other known heat exchange apparatus of either regenerative or recuperative type. Additionally, various element configurations, some of which have been alluded to herein, may be readily incorporated in the heat transfer basket assembly of the present invention by those skilled in the art. Therefore, it is intended by the appended claims to cover the modifications alluded to herein as well as all other modifications which fall within the true spirit and scope of the present invention as defined by said claims.

We claim:

1. An element basket assembly for use in a rotary regenerative heat exchanger comprising a plurality of heat transfer element plates juxtaposed in a stacked array so as to form a plurality of flow passages therethrough, and a basket frame surrounding the stacked array of heat transfer element plates in supporting relationship therewith, said basket frame comprising:

a. first and second shell members disposed in spaced parallel relationship, said first shell member disposed along the upper portion of the stacked array of heat transfer element plates and said second shell member disposed along the lower portion of the stacked array of heat transfer element plates, each of said first and second shell members comprising an elongated plank-like member formed into a trough-like member having a base end portion and a pair of spaced legs extending outwardly from the base and portion thereof;

b. means for interconnecting the base end portion of the first shell member to the base end portion of the second shell member;

c. an end closure member mounted between the outboard ends of the spaced legs of the first and second shell members to form a frame about the stacked array of heat transfer element plates; and d. means abutting the upper and lower surfaces of the stacked array of heat transfer element plates and connected to the frame for retaining the heat transfer plates within the frame.

2. An element basket assembly as recited in claim 1 wherein said means for interconnecting the base end portion of the first shell member to the base end portion of the second shell member comprise a pair of spaced angle bars extending vertically between and interconnecting the corners of the trough-like first shell member to the corners of the trough-like second shell member.

3. An element basket assembly as recited in claim I wherein said means abutting the upper and lower surfaces of the stacked array of heat transfer plates and connected to the frame for holding the heat transfer plates within the frame comprises at least one retaining bar mounted between the first shell member and the end closure member and extending across the upper surface of the stacked array of heat transfer element plates, and at least one retaining bar mounted between the second shell member and the end closure member and extending across the lower surface of the stacked array of heat transfer element plates.

4. An element basket assembly as recited in claim 1 wherein the spaced legs of each of said first and second shell members extending outwardly in a diverging manner.

* * * * *